US009721543B1

(12) United States Patent
White

(10) Patent No.: US 9,721,543 B1
(45) Date of Patent: Aug. 1, 2017

(54) 3-POINT SEPARABLE GUITAR NECK ATTACHMENT SYSTEM

(71) Applicant: Timothy P. White, New Boston, NH (US)

(72) Inventor: Timothy P. White, New Boston, NH (US)

( * ) Notice: Subject to any disclaimer, the term of this patent is extended or adjusted under 35 U.S.C. 154(b) by 0 days.

(21) Appl. No.: 14/995,373

(22) Filed: Jan. 14, 2016

Related U.S. Application Data

(60) Provisional application No. 62/103,753, filed on Jan. 15, 2015, provisional application No. 62/103,759, filed on Jan. 15, 2015, provisional application No. 62/103,767, filed on Jan. 15, 2015.

(51) Int. Cl.
*G10D 3/06* (2006.01)
*G10D 1/08* (2006.01)

(52) U.S. Cl.
CPC ..... *G10D 3/06* (2013.01); *G10D 1/08* (2013.01)

(58) Field of Classification Search
CPC .. G10D 3/06; G10D 1/08; G10D 3/00; G10D 3/14; G10D 3/143; B27F 1/08; B27M 3/00; B29C 44/02; G01B 5/20
USPC ..... 84/267, 290, 291, 293
See application file for complete search history.

(56) References Cited

U.S. PATENT DOCUMENTS 5,353,672 A * 10/1994 Stewart ..... G10D 3/06 84/267
5,945,614 A * 8/1999 White ..... G10D 1/08 84/267

* cited by examiner

*Primary Examiner* — Kimberly Lockett
(74) *Attorney, Agent, or Firm* — Luis Figarella

(57) ABSTRACT

A 3-point neck attachment system is disclosed where the neck of a guitar is mounted on a guitar body with the neck and body making contact at three points, each contact point consisting of a screw-adjustable member and a contact surface. Two screw-adjustment members are located in the neck pocket of the guitar body and allow fine adjustment of neck yaw angle and overall scale length. A third screw-adjustable member is mounted vertically in the heel of the neck and allows fine adjustment of the neck angle. The geometry of the contact surfaces can be configured to allow the neck to be easily and securely mounted to the guitar body without fasteners, employing only the strings' tension. When combined with a quick string de-tensioning mechanism, the fastener-free neck joint allows the guitar to be quickly disassembled, either for transport or rapid substitution of interchangeable guitar components, and then to be easily and rapidly re-assembled to pitch and precisely adjusted for optimum playing. The neck attachment further allows the guitar to be sold as a kit of parts that can be easily, quickly and precisely assembled by the user.

15 Claims, 14 Drawing Sheets

Prior Art (Detail)

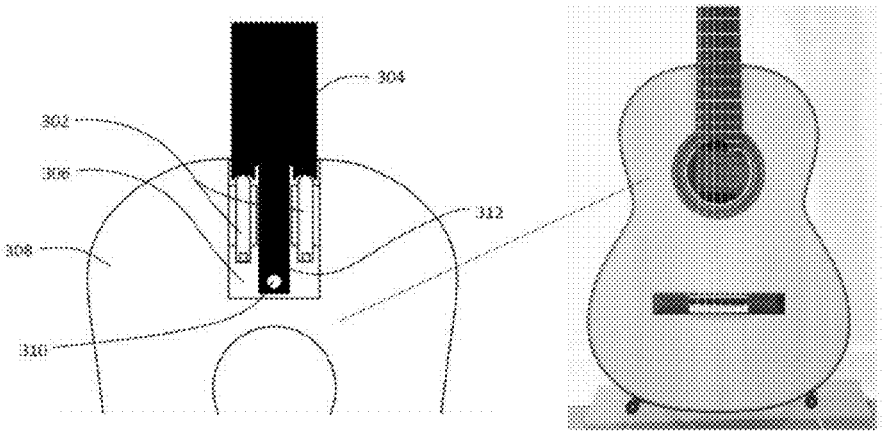
Figure 3A
Figure 3B
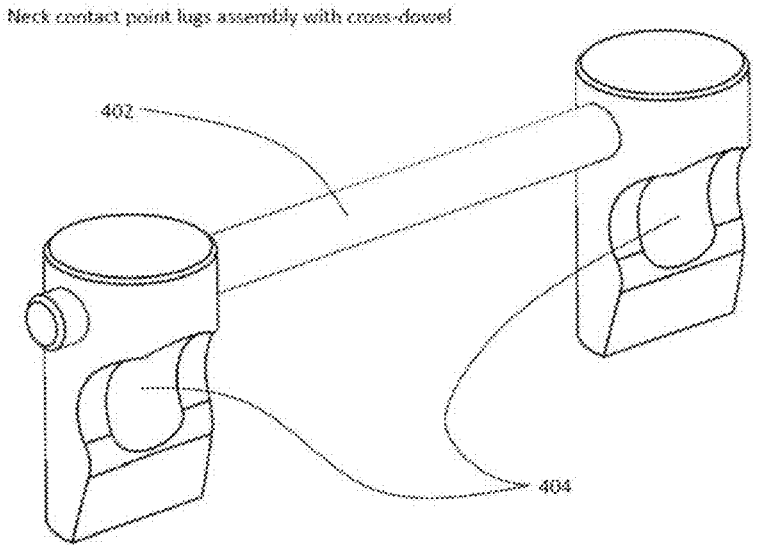
Figure 4

3-POINT SEPARABLE GUITAR NECK ATTACHMENT SYSTEM

CROSS-REFERENCE TO RELATED APPLICATIONS

The following documents and references are incorporated by reference in their entirety; White U.S. Provisional Application Nos. 62/103,753; 62/103,759 and 62/103,767.

PATENTS CITED

The following documents and references are incorporated by reference in their entirety, White (U.S. Pat. Nos. 4,573,391; 5,945,614; 6,188,005).

FIELD OF THE INVENTION

The invention relates to knock-down musical instruments and specifically to a knock-down guitar suitable for assembly/disassembly during storage.

DESCRIPTION OF THE RELATED ART

The neck of a guitar is comprised of a rigid slab typically made of wood, plastic, metal or composite, or a combination thereof, and is typically attached to the guitar's body by means of several wood screws or bolts, or else the neck may be a seamless extension of the guitar's body, known as a "thru-neck" configuration.

It is useful to be able to disassemble a guitar for the purposes of repair, modification or transport, and to precisely adjust the length and orientation of the neck with respect to the body for optimum playability, however this is difficult or impossible by the screw-attached or thru-neck configurations.

Prior art knock-down guitar designs allowing removal or compactification of the neck typically employ one or more removable threaded fasteners such as hand-tightened bolts, either alone or in combination with a hinge mechanism.

Such prior art knock-down neck mechanisms are incapable of fine adjustment of neck orientation and length with respect to the body. A prior art knock-down guitar (White, U.S. Pat. No. 4,573,391) teaches a separable 2-point neck attachment mechanism allowing the neck to be held on by string tension alone, whereby two threaded neck adjustment screws are mounted in the heel of the neck which protrude into a pair of holes in the front edge of a two-part guitar body, where they are intended to hold the two halves of the guitar together.

However in the White 391 configuration, no means is provided to maintain precise longitudinal and horizontal registration of the two halves of the guitar's body when the instrument is assembled, preventing the neck's yaw angle with respect to the body being adjusted or maintained with the required precision of a small fraction of a degree. Further, the White 391 configuration provides no means to precisely adjust the neck angle to the necessary precision of a small fraction of a degree, which is key to achieving optimum playability.

Further, despite its inclusion of a cam lever string detensioning mechanism in the headstock, the White 391 configuration requires a difficult assembly procedure where the two screws protruding from the neck must be inserted into their respective holes in the front edge of the otherwise unattached body halves, and the whole uncontrolled assemblage somehow held in place while the instrument's bridge and headstock are attached and the strings brought to tension.

It is notable that the complete White 391 configuration could not be reduced to practice due to the lack of means and procedure for holding the various instrument components in proper respective alignment in a controlled manner while attaching the neck and tensioning the strings.

These numerous shortcomings of the White 391 design prevented it from being a useful musical instrument, and was therefore not teaching. While guitars can be purchased and assembled from kits, such kits require the various components to be rigidly attached with screws, glue or some combination thereof, and, after being assembled, remain assembled.

The disclosed neck attachment mechanism allows a violin-sized kit of precisely fitting guitar components to be assembled in a few seconds into a properly-adjusted full-size guitar.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is about a separable neck attachment mechanism for a stringed musical instrument such as a guitar, comprised of: a neck pocket of a guitar body shaped to accept a portion of the instrument's neck; said neck pocket containing at least one adjustable hard-point making contact with at least one corresponding bearing surface on the accepted portion of the instrument's neck; said at least one neck pocket adjustable hard point and its corresponding neck bearing surface being comprised of wood, plastic, metal, glass, fiber-based composite, ceramic or any combination thereof; said at least one neck pocket adjustable hard point being of a screw type, enabling precise adjustment of the orientation and offset of the instrument neck with respect to the instrument body; and said at least one neck pocket adjustable hard point and its corresponding neck bearing surface having a geometry allowing the instrument neck and instrument body to be held together by the tension of the instrument's strings.

In another aspect, said at least one adjustable neck pocket adjustable hard point is capable of making precise adjustments to the overall length of the assembled instrument body and neck. In yet another aspect, the neck pocket contains two laterally disposed longitudinally aligned screw adjustable hard points such as set screws. In another aspect, the portion of the neck in the body neck cavity contains at least one approximately vertically aligned adjustable hard point such as a set screw, capable of precisely adjusting the clearance between the floor of the neck cavity and the bottom surface of the neck's accepted portion. In another aspect, the neck vertical adjustment set screw is accessed via a hole through the fingerboard. In yet another aspect, a neck tension rod adjustment screw can be accessed through the end of the neck through the vertical set screw adjustment well. In another aspect, the neck bearing surfaces are comprised of shaped inserts made of a hard material such as metal, ceramic or composite. In yet another aspect, said shaped inserts are removable and replaceable with alternative inserts with different shape.

In another aspect contact surfaces of said removable shaped inserts are designed to achieve a desired over-center force profile "click" when the instrument body and neck are assembled together with tensioned or partially tensioned strings. In yet another aspect, the contact surfaces of said shaped inserts may be designed with alternative geometries to achieve different over-center "click" force profiles when the instrument body and neck are assembled. In another aspect, the guitar body is comprised of two separate body halves capable of being joined together, each such separable body half bearing its own half of the neck cavity. In yet another aspect, a locking feature such as a removable taper pin holds the two body halves in rigid longitudinal alignment when the instrument is assembled. In another aspect, the instrument is formulated as a kit consisting of loose components for the purposes of sale and transport, said loose components being capable of being rapidly assembled without tools into a precisely-adjusted fully-functional guitar.

Other features and advantages of the present invention will become apparent upon examining the following detailed description of an embodiment thereof, taken in conjunction with the attached drawings.

BRIEF DESCRIPTION OF THE DRAWINGS

FIGS. 3A-3B illustrate guitar neck versions, according to exemplary embodiments of the invention.

FIG. 4 illustrates a guitar neck version, according to an exemplary embodiment of the invention.

Figure 1:
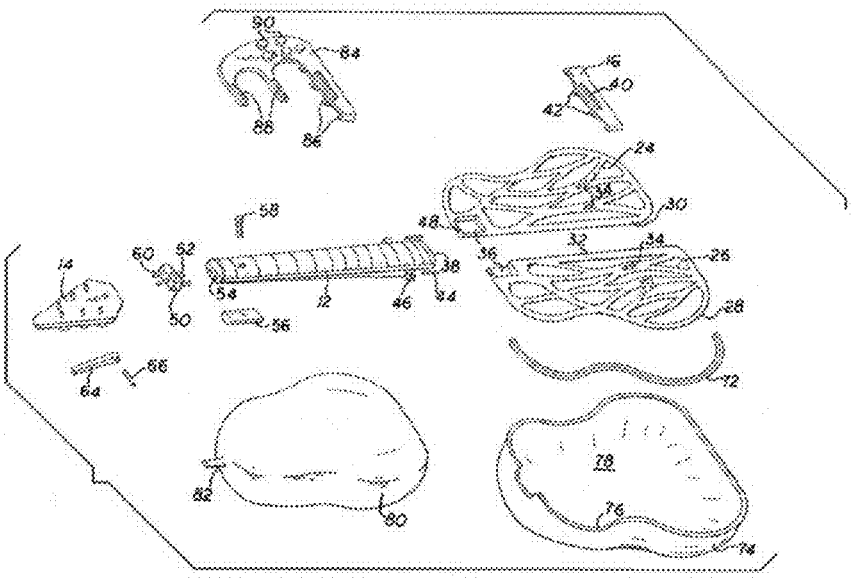
FIG. 1 illustrates a guitar neck, according to an exemplary embodiment of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Figure 2:
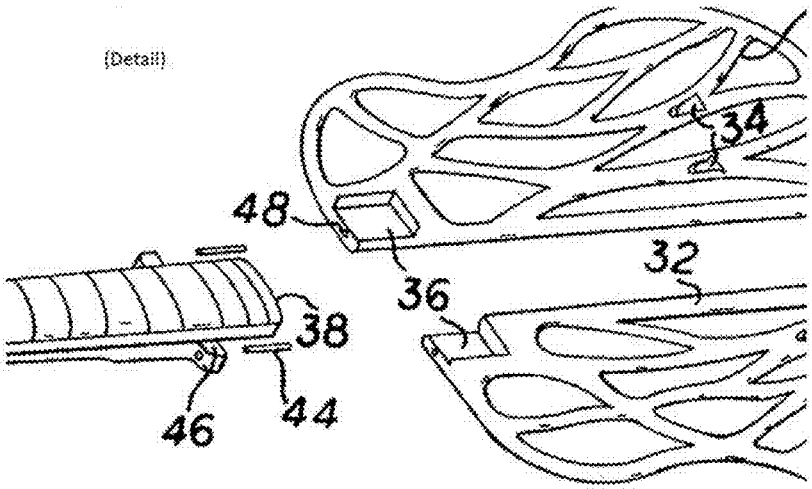
Figure 2 Prior Art
FIG. 2 illustrates a guitar neck connection area, according to an exemplary embodiment of the invention.
Figure 5:
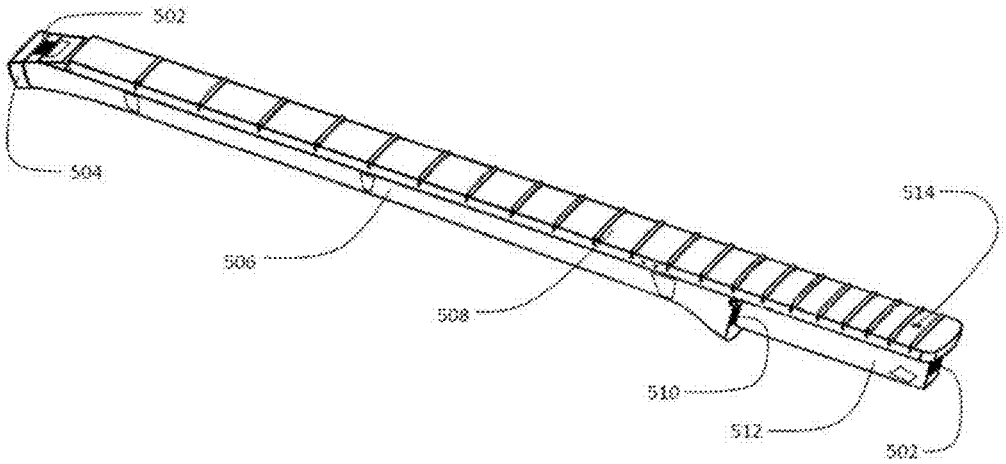
FIG. 5 illustrates a guitar neck attachment option, according to an exemplary embodiment of the invention.
Figure 6:
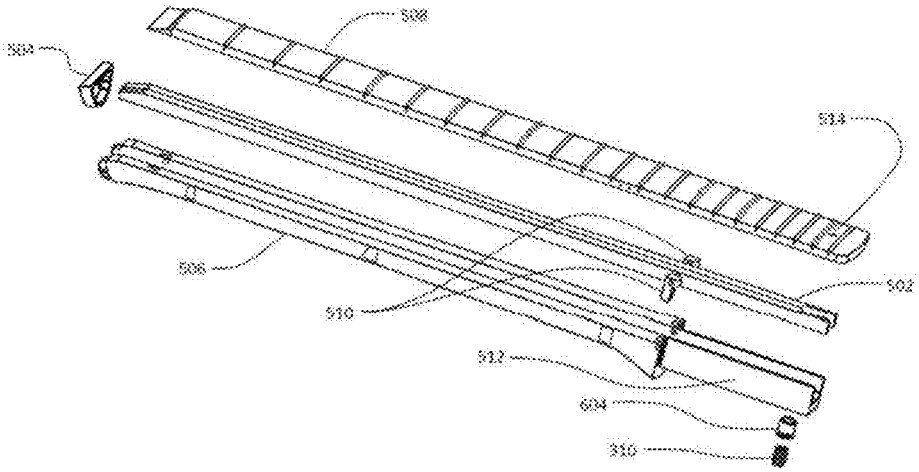
FIG. 6 illustrates a guitar neck version, according to an exemplary embodiment of the invention.
Figure 7:
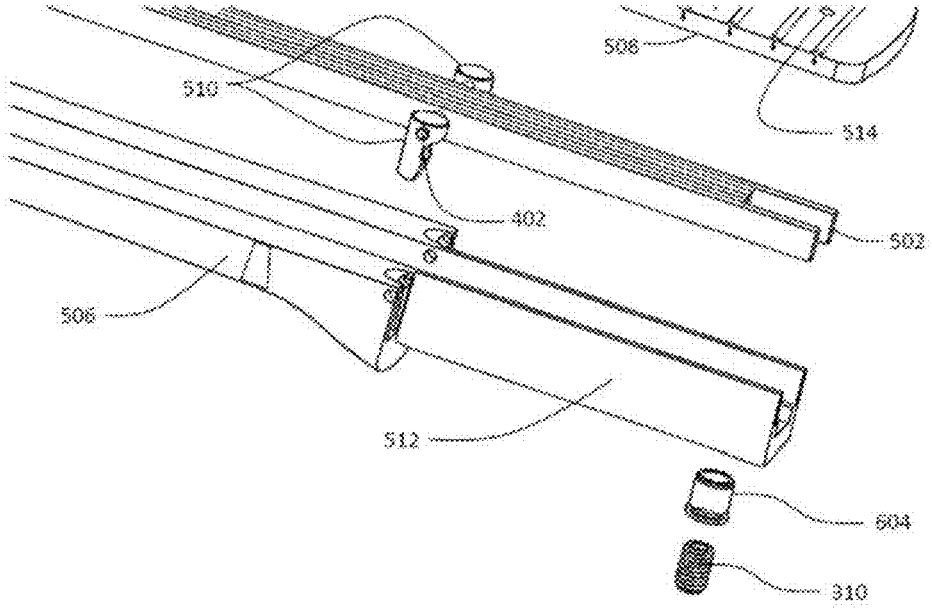
FIG. 7 illustrates a guitar neck version, according to an exemplary embodiment of the invention.
Figure 8:
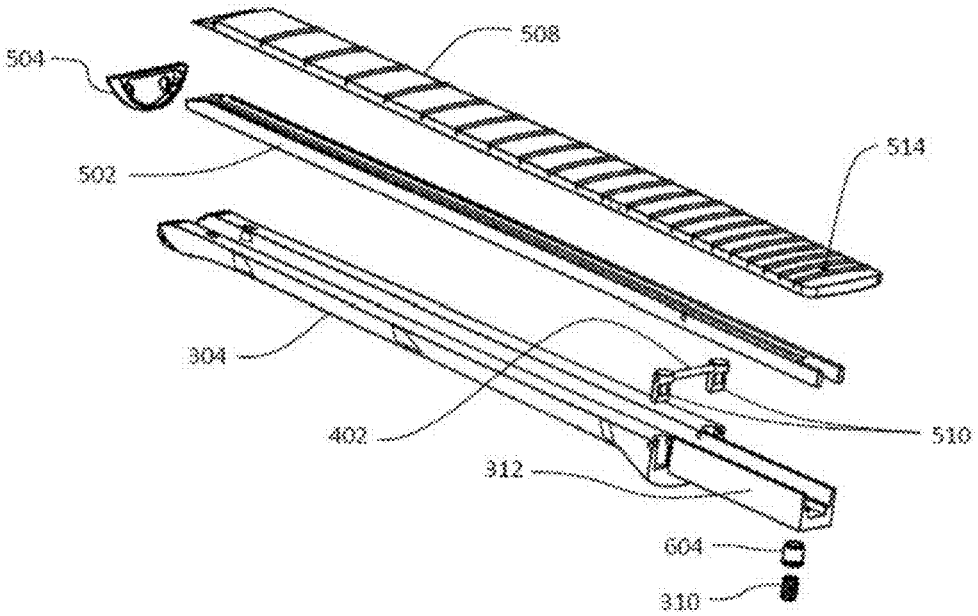
FIG. 8 illustrates a guitar neck version, according to an exemplary embodiment of the invention.
Figure 9:
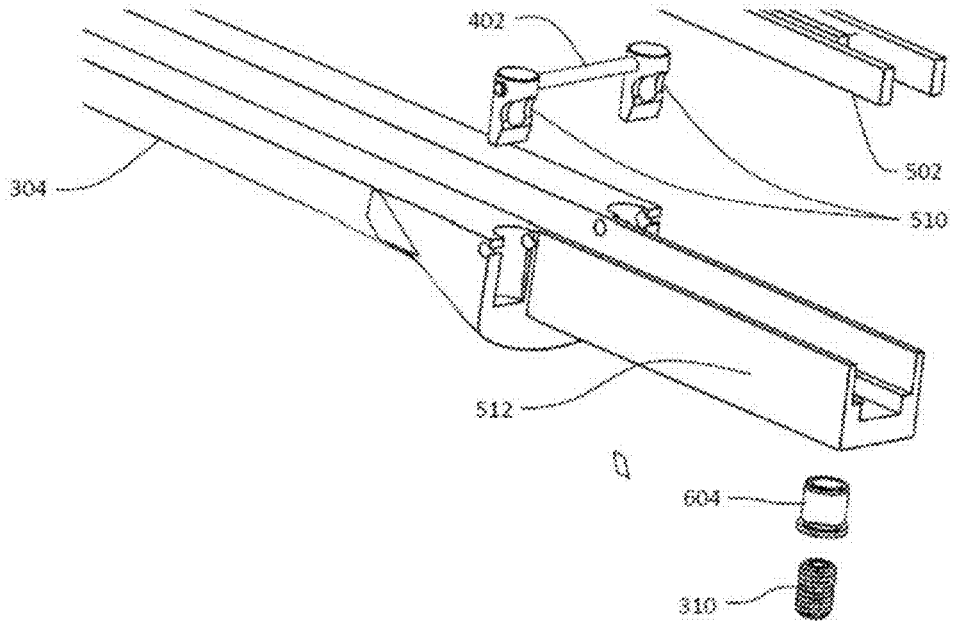
FIG. 9 illustrates a guitar neck version, according to an exemplary embodiment of the invention.
Figure 10:
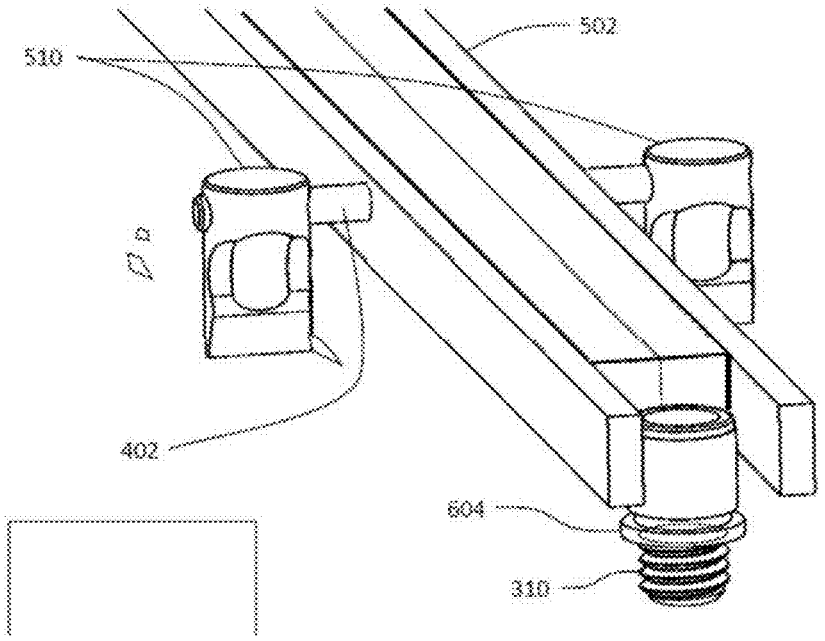
FIG. 10 illustrates a guitar neck version, according to an exemplary embodiment of the invention.
Figure 11:
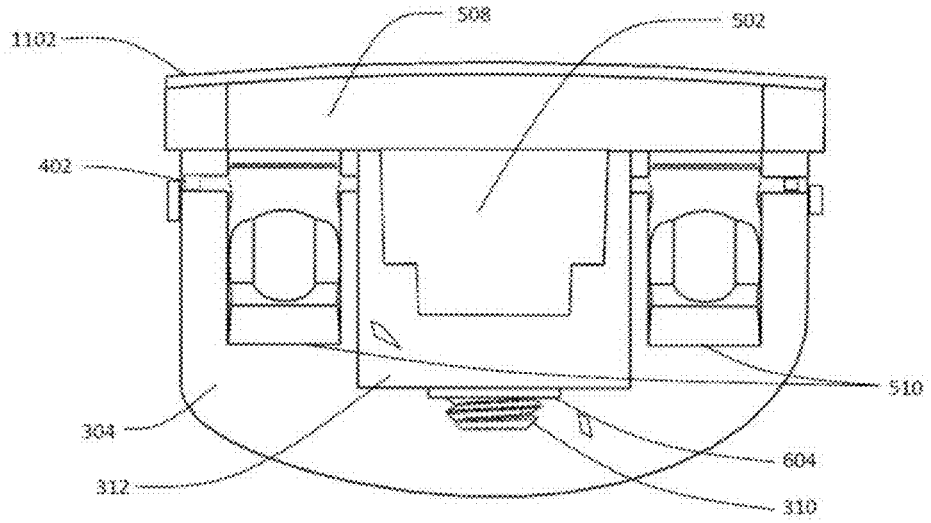
FIG. 11 illustrates a guitar neck version, according to an exemplary embodiment of the invention.
Figure 12:
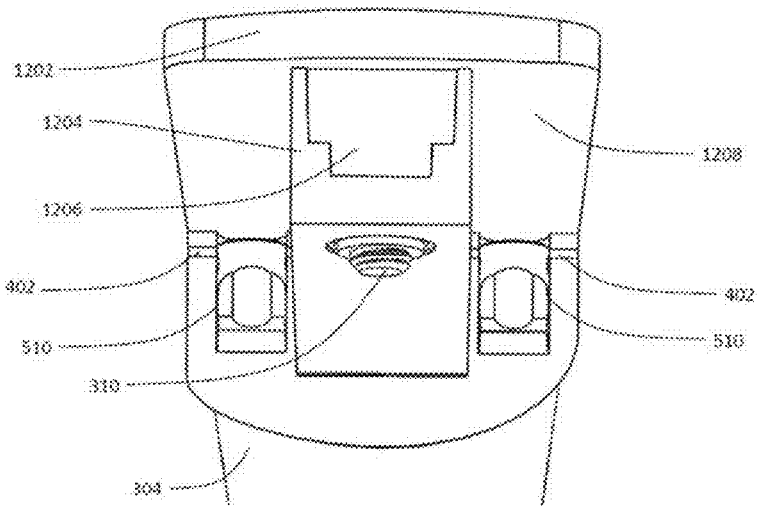
FIG. 12 illustrates a guitar neck version, according to an exemplary embodiment of the invention.
Figure 13:
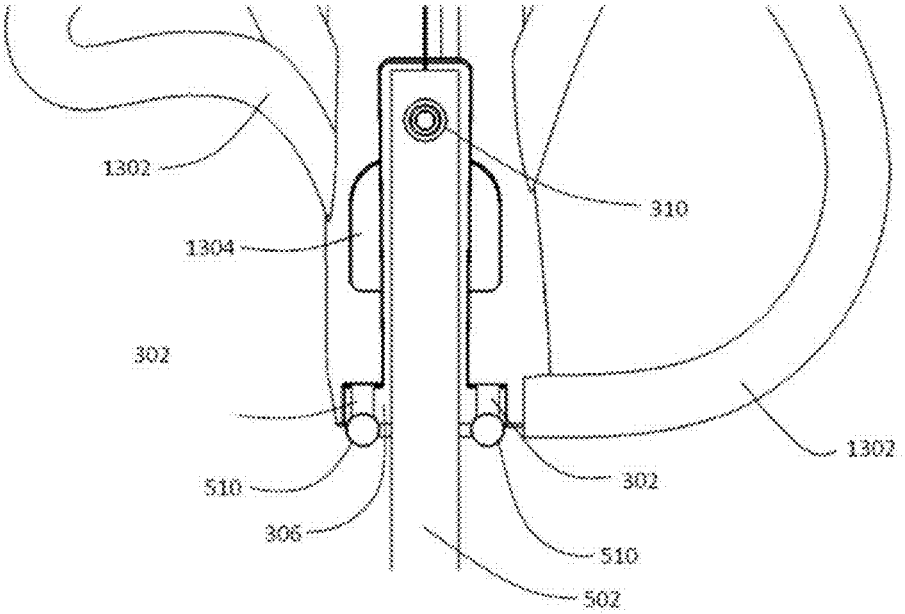
FIG. 13 illustrates a guitar neck version, according to an exemplary embodiment of the invention.
Figure 14:
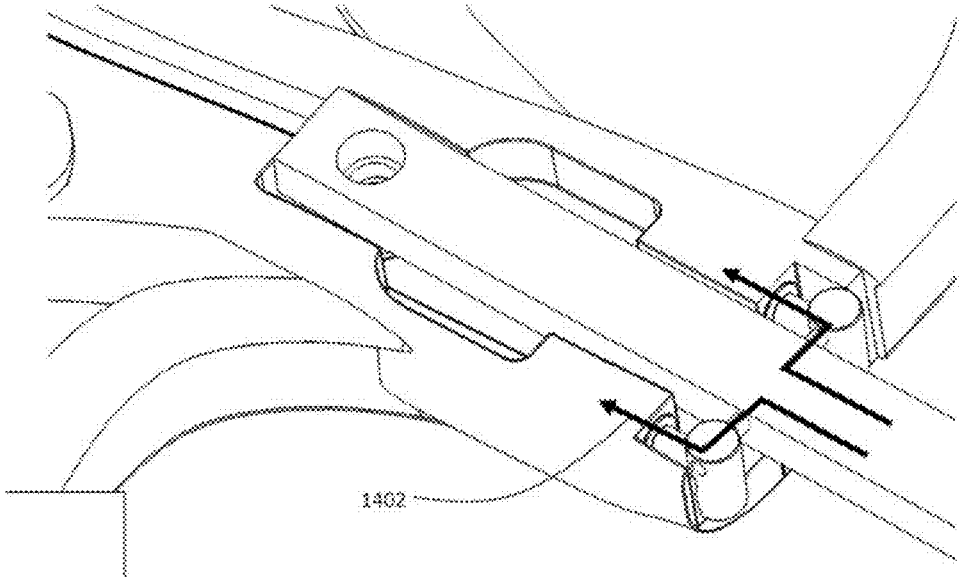
FIG. 14 illustrates a guitar neck attachment detail, according to an exemplary embodiment of the invention.
Figure 15:
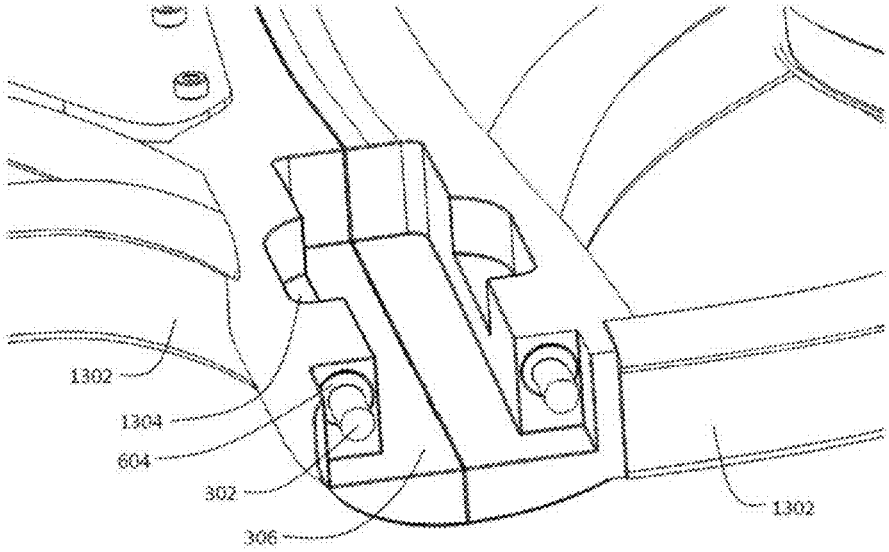
FIG. 15 illustrates a guitar neck attachment detail, according to an exemplary embodiment of the invention.
Figure 16:
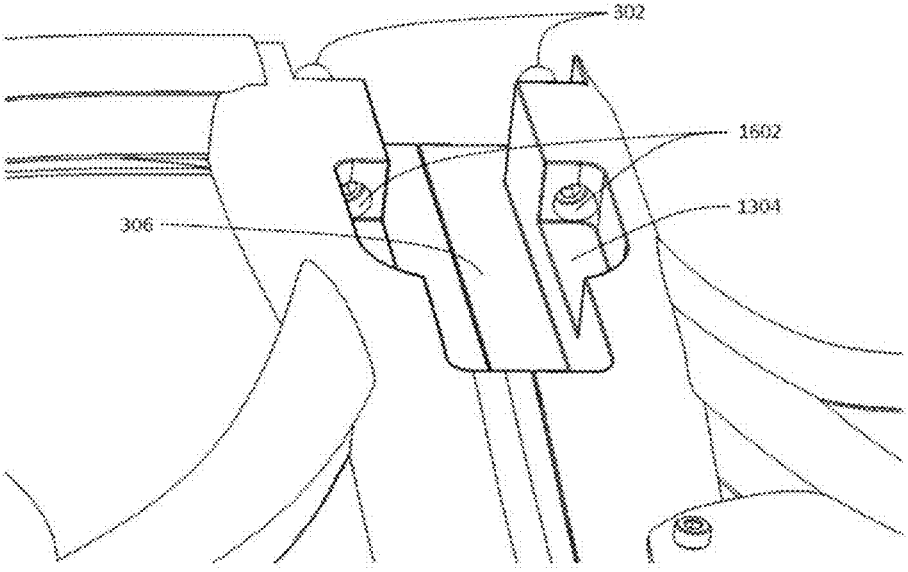
FIG. 16 illustrates a guitar neck attachment detail, according to an exemplary embodiment of the invention.
Figure 17:
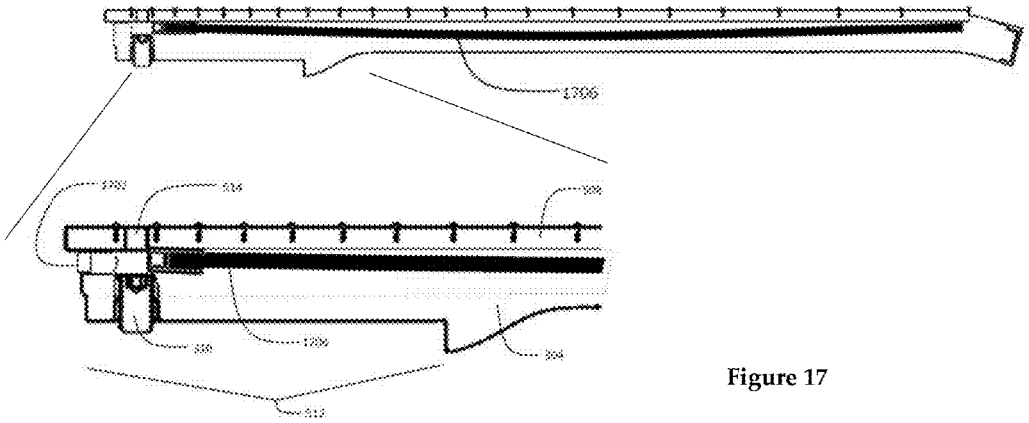
FIG. 17 illustrates a guitar neck locking detail, according to an exemplary embodiment of the invention
Figure 18:
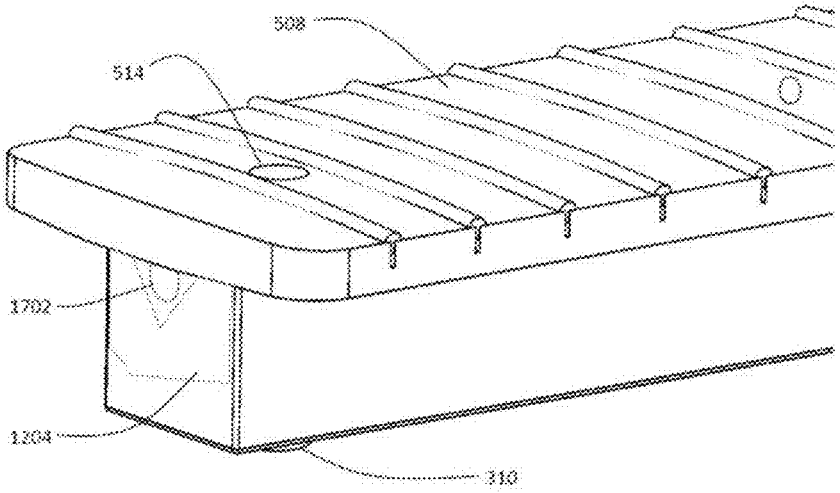
FIG. 18 illustrates a guitar neck locking detail, according to exemplary embodiments of the invention.
Figure 19:
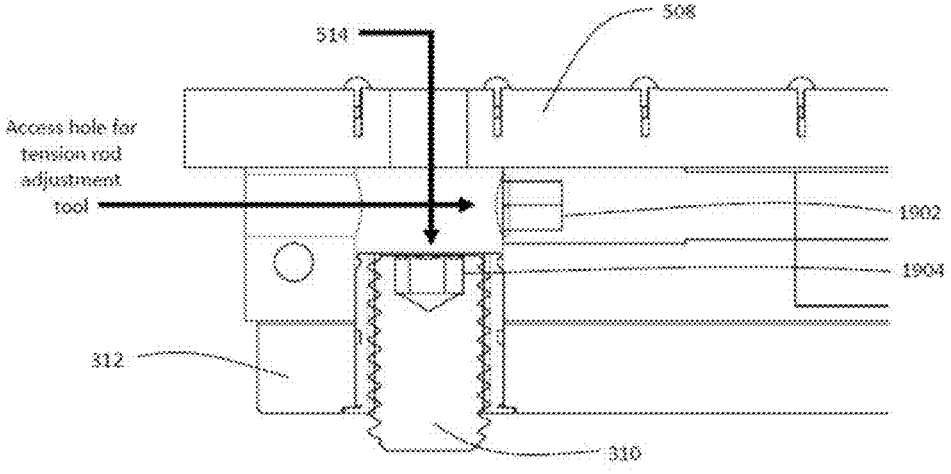
FIG. 19 illustrates further guitar neck locking details, according to an exemplary embodiments of the invention.
Figure 20:
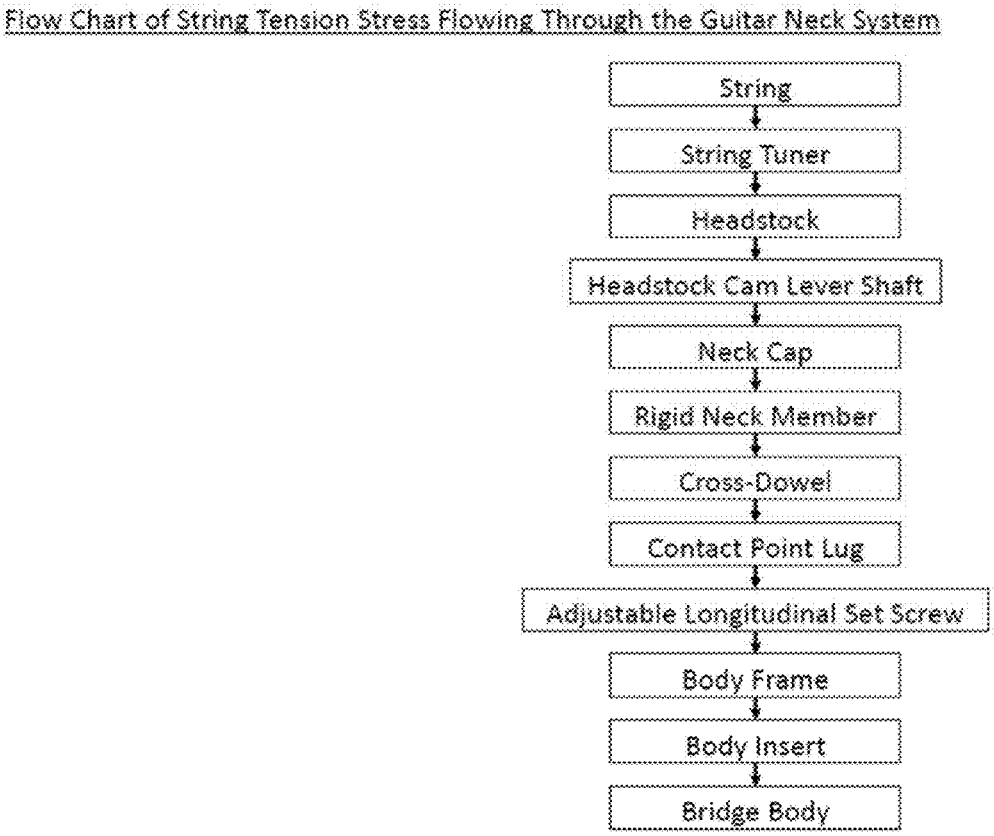
FIG. 20 illustrates further guitar neck locking details, according to exemplary embodiments of the invention.
Figure 21:
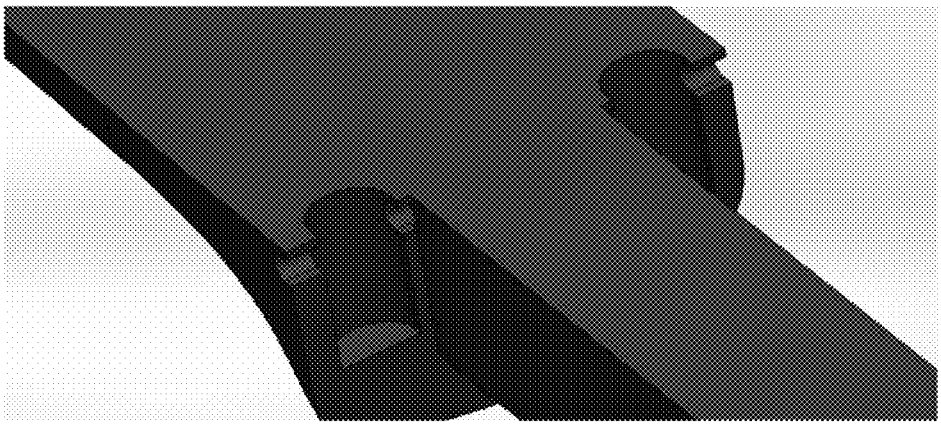
FIG. 21 illustrates further guitar neck locking details, according to exemplary embodiments of the invention.
Figure 22:
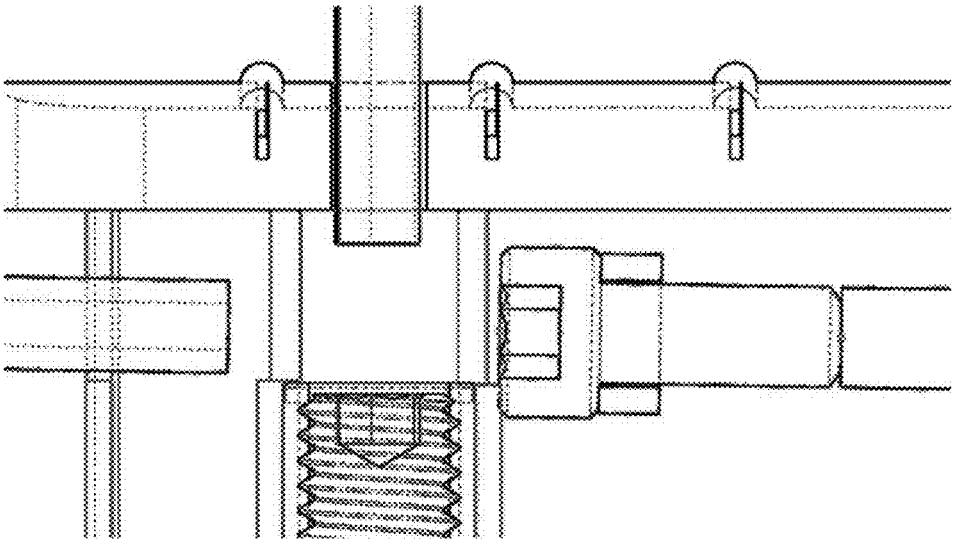
FIG. 22 illustrates further guitar neck locking details, according to exemplary embodiments of the invention.
Figure 23:
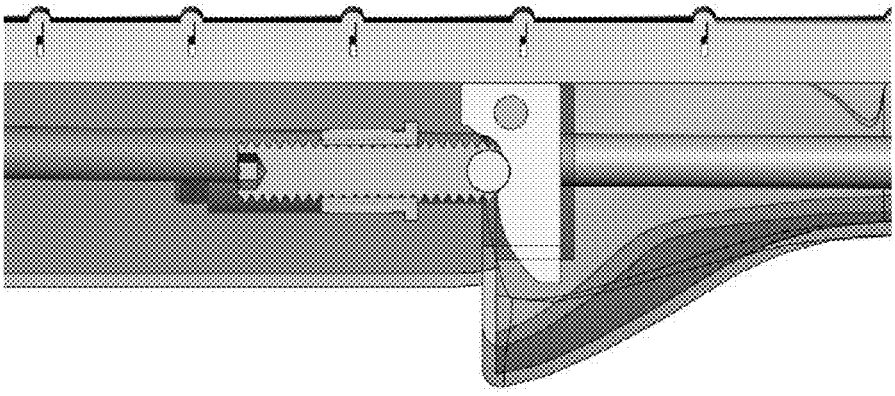
FIG. 23 illustrates further guitar neck locking details, according to exemplary embodiments of the invention.
Figure 24:
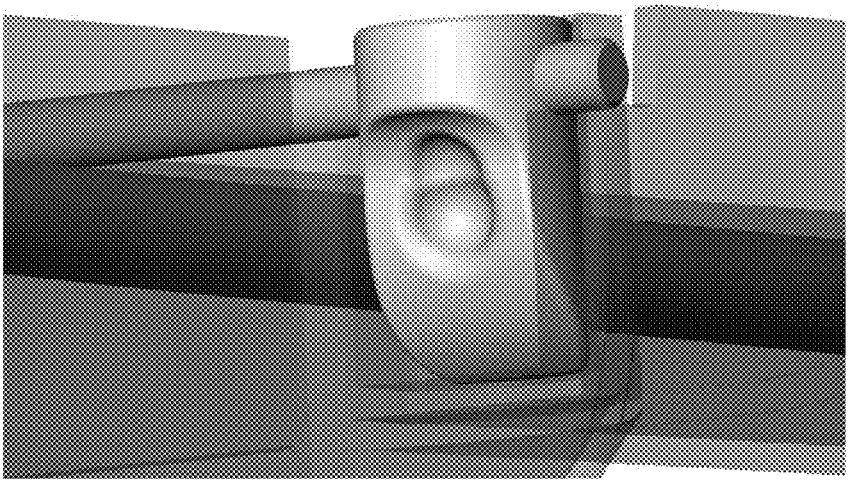
FIG. 24 illustrates further guitar neck locking details, according to exemplary embodiments of the invention.
Figure 25:
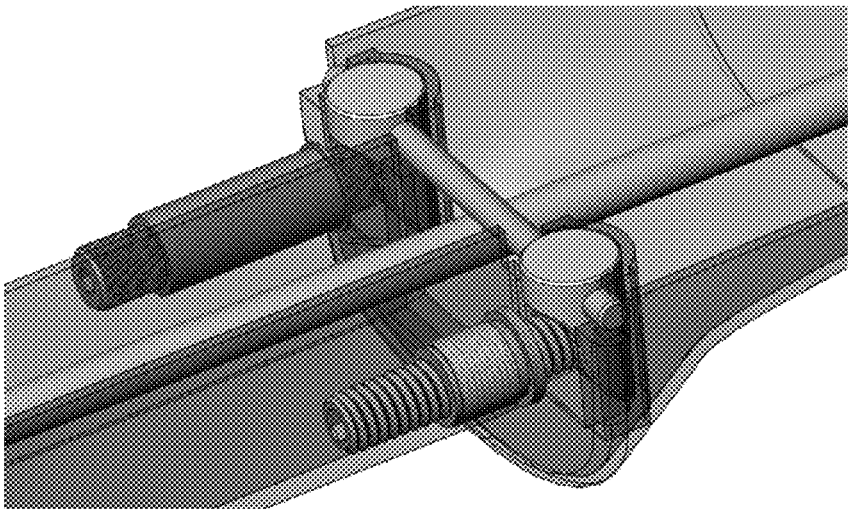
Figure 26:
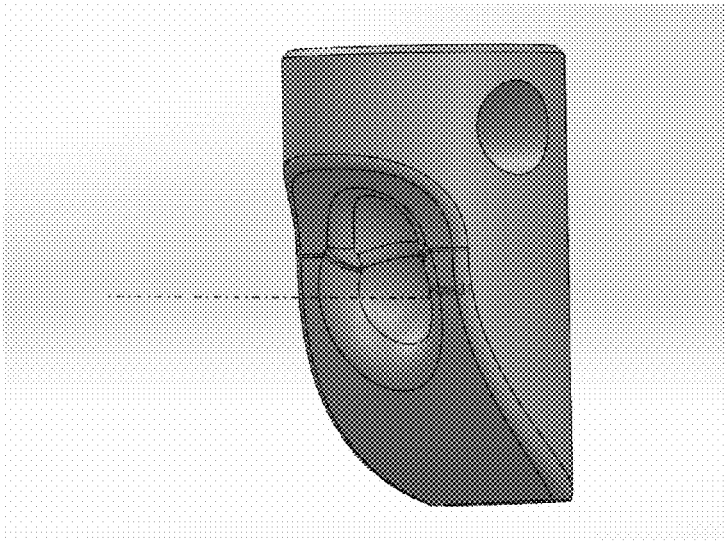

Referring to FIGS. 1-24, we understand that the guitar body, which can be comprised of two separable pieces, has a neck pocket for accepting a portion of the guitar's neck, known as the neck's "heel", having a geometry allowing its surfaces to come in close proximity but not tight fit with the opposed surfaces of the neck pocket, thus allowing the neck heel to "float" and be easily inserted into and removed from the neck pocket without friction.

In the body's 308 neck cavity are mounted an opposed pair of longitudinally-oriented screw-adjustable members 302, such as set screws 310, preferably of a very fine thread pitch such as ¼"-80, which protrude slightly forward from the neck pocket 306 and, in the assembled instrument, make contact with respective contact surfaces 404 connected by a cross-dowel 402 on rear of the neck shaft 304, that is the neck heel 312.

The neck heel contact surfaces can be comprised of bare or finished wood, or else the engineered surfaces of small metal, ceramic or composite appliances, designed and assembled into the neck heel to prevent damage to the neck heel by the adjustment screws, and including concave pockets for firmly holding the tips of the adjustment screws under the tension of the strings.

The contact surfaces' geometries are sculpted to provide a desired over-center force profile when the neck heel is inserted in the neck pocket and the neck is rotated down until the strings begin to come under tension, and the nose of the adjustment screws finally "click" into place in the concave pockets of their respective neck heel contact surfaces.

When the neck pocket adjustment screws are in contact with their respective concave pockets, they form "ball-and-socket" joints 502 which are rigid in the longitudinal direction, but allow the neck to rotate slightly around an axis defined by a line between the centers of the two ball-and-socket contact surface hemispheres.

The majority of the force of the strings' tension holds the neck pocket adjustment screws firmly in their respective contact surface pockets, joining the neck rigidly to the body in the longitudinal direction, while the remainder of the string tension force induces a moment to the neck, causing it to rotate up around the above defined axis, resulting in the guitar's strings being too high above the freeboard for regular playing, except perhaps for "slide" playing.

To allow the neck angle to be adjusted so as to bring the strings to an ideal height for playing, a third adjustable member, preferably a threaded set screw, is mounted vertically in the rear end of the neck such that when it is rotated by means of a wrench accessing it through a hole in the fingerboard 508, it presses against the floor of the neck pocket, causing the heel of the neck to lift, and, acting as a first order lever, causing the overall neck to rotate down, lowering the strings closer to the fingerboard for optimum playability.

Together, the two longitudinal set screws and the rear vertical set screw 310 are the only points, other than the strings themselves, where the guitar neck 506 and guitar body 308 make contact.

The neck has a cap 504 and body 506 that may incorporate a 2-way adjustable tension rod which is adjustable via an Allen wrench through the end of the neck heel, without interfering with the vertical set-screw neck angle adjustment mechanism, through the gap between the top of the vertical set screw and the bottom surface of the fingerboard 508, contact point lug 510, threaded insert 602, neck heel 512 and access port 514 to a vertical adjustable screw. The fret 1102, end of fingerboard 1202, end of the hell of neck 1204, end of rigid member inside neck 1206 and bottom surface of the fingerboard 1208 are seen. The guitar body frame 1302, and body neck pocket shelf 1304. The stress flow 1402 is shown.

The 3-point neck attachment mechanism, in combination with a string tension quick-release mechanism located in either the headstock, neck or body of the guitar, results in an instrument so easy and quick to assemble or dis-assemble, that it becomes feasible for the guitar to be sold as an un-assembled kit of loose components, including headstock, neck, bridge and body or split body halves. The access port for adjusting the tension port rod 1702, bi-directional adjustable tension rod 1704, and uni-directional adjustable tension rod 1706. The Tension rod adjustment hex socket 1902, and vertical adjustment set screw hex socket 1904.

An additional consequence of the 3-point neck attachment mechanism is that any of a given guitar's components can be easily "swapped-out" and substituted with other components of the same type but having different materials or other properties, as long as the substituted components incorporate the identical joining features.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

I claim:

1. A separable neck attachment mechanism for a stringed musical instrument comprised of:

a neck pocket shaped to accept a portion of said instrument's neck;

said neck pocket containing at least two adjustable contact points making contact with at least two corresponding bearing surfaces on the said instrument's neck, the portion of the said neck accepted by the said neck pocket including near its rear-most end at least one adjustable vertical hard-point mechanism oriented within 45 degrees of normal to the floor of the neck cavity, said mechanism comprised of an adjustable set screw or cam mechanism capable of adjusting the vertical height of the space formed between the lower surface of the end of the said neck portion and the opposed neck cavity surface, such vertical adjustment mechanism being capable of controlling the height and angle of the instrument's strings above the said neck's playing surface;

each said adjustable contact point as well as each corresponding neck bearing surface may be comprised of one or more of the following materials: wood, plastic, metal, glass, fiber-based composite, ceramic and/or any combination thereof; and wherein each said adjustable contact point is of a screw or cam type.

2. The neck mechanism according to claim 1, whereby;

each said neck pocket hard point is capable of precise length adjustments to the overall length of the assembled instrument body and neck and strings.

3. The neck mechanism according to claim 1, whereby;

said neck pocket contains two laterally disposed longitudinally aligned adjustable hard points comprised of set screws or cams.

4. The neck mechanism according to claim 1, whereby;

the portion of the neck in the body neck cavity contains at least one approximately vertically aligned adjustable hard point a set screw, capable of precisely adjusting the clearance distance between the floor of the neck pocket and the bottom surface of the neck's heel.

5. The neck mechanism according to claim 4, whereby;

said set screw is accessed via a hole through the fingerboard.

6. The neck mechanism according to claim 5, where;

the neck tension rod adjustment screw can be accessed through the end of the neck through said set screw adjustment well.

7. The neck mechanism according to claim 6, whereby;

the neck bearing surfaces are comprised of shaped inserts made of a hard material from a group comprised of metal, ceramic and/or composite materials.

8. The shaped inserts according to claim 7, whereby;

said shaped inserts are removable and replaceable with alternative inserts with different shape.

9. The shaped inserts according to claim 8, whereby;

the contact surfaces of said removable shaped inserts are designed to achieve a desired over-center force profile tactile sensible event and audible sound when the instrument body and neck are assembled together with tensioned or partially tensioned strings.

10. The shaped inserts according to claim 9, whereby;

the contact surfaces of said shaped inserts may be designed with alternative geometries to achieve different over-center tactile sensible event and audible sound force profiles when the instrument body and neck are assembled.

11. The guitar body and neck pocket according to claim 1, wherein;

the guitar body is comprised of two separate body halves or similar body segments capable of being joined together, each such separable body half or similar body segments forming a portion of the neck cavity.

12. The separable body and neck cavity segments according to claim 11, where;

at least one locking feature fixed or removable taper pin or a lever with at least one tapered contact surface holds the two body segments in rigid longitudinal alignment when the instrument is assembled.

13. The separable guitar body and neck components according to claim 1, whereby;

the instrument is formulated as a kit consisting of loose components, said loose components capable of rapid assembly without tools into a precisely-adjusted fully-functional guitar of traditional size and shape held together by the string's tension.

14. The separable guitar body and neck components according to claim 1, whereby;

the distal end of the neck presents an attachment means capable of supporting a separable interchangeable headstock incorporating an automatic string self-tuning mechanism.

15. A separable neck attachment mechanism for a stringed musical instrument comprised of:

a neck pocket shaped to accept a portion of said instrument's neck;

said neck pocket containing at least three adjustable contact points making contact with at least three corresponding bearing surfaces on the said instrument's neck, with at least one said contact point comprised of an adjustable set screw or cam mechanism capable of adjusting the vertical height of the space formed between the lower surface of the end of the said neck portion and the opposed neck cavity surface, each said adjustable contact point as well as each corresponding neck bearing surface may be comprised of one or more of the following materials: wood, plastic, metal, glass, fiber-based composite, ceramic and/or any combination thereof; and wherein each said adjustable contact point is of a screw or cam type.

* * * * *